United States Patent [19]

Ho

[11] Patent Number: 4,787,918

[45] Date of Patent: Nov. 29, 1988

[54] PROCESS FOR PRODUCING DEEP CLEANED COAL

[75] Inventor: Ken K. Ho, Worthington, Ohio

[73] Assignee: The Babcock & Wilcox Company, New Orleans, La.

[21] Appl. No.: 925,182

[22] Filed: Oct. 31, 1986

[51] Int. Cl.[4] ..... C10L 5/00

[52] U.S. Cl. ..... 44/624; 44/625; 44/627

[58] Field of Search ..... 44/1 R, 1 SR, 1 B, 621, 44/622, 624, 625, 627; 201/17; 423/460, 461

[56] References Cited

U.S. PATENT DOCUMENTS

| | | | |
|---|---|---|---|
| 3,815,826 | 6/1974 | Aldrich et al. | 241/1 |
| 3,850,477 | 11/1974 | Aldrich et al. | 299/5 |
| 3,870,237 | 3/1975 | Aldrich | 241/1 |
| 4,183,730 | 1/1980 | Dondelewski | 44/1 SR |
| 4,203,727 | 5/1980 | Simpson | 44/1 SR |
| 4,319,980 | 3/1982 | Jenkins | 44/1 B |
| 4,328,002 | 5/1982 | Bender | 44/1 SR |
| 4,424,062 | 1/1984 | Kamino et al. | 44/1 SR |
| 4,441,886 | 4/1984 | Muchmore et al. | 44/1 SR |
| 4,476,012 | 10/1984 | Gatis | 44/1 B |
| 4,546,925 | 10/1985 | Spiro | 241/1 |

OTHER PUBLICATIONS

Keller, Jr., D. V.-"Coal Refinning by Physical Methods for the Preparation of coal Slurries with Less Than One Weight Percent Ash"—5th Int. Symp. on Coal Slurry for Combustion and Tech., Tampa, Florida, Apr., 1983—U.S.D.O.E., Pittsburgh pp. 269-278.

Capes, et al—"Selective Oil Agglomeration: An Answer to Fine Coal Treatment Problems"—Coal: Phoenix of the 80's-Proceedings of 64th CIC Coal Symposium—A.M. Al Taweel, ed., C.S. Ch.E., Ottawa (1982) vol. 1, pp. 209-216.

Attia, Y.-"Fine/Ultrafine Coal Cleaning by Selective Flocculation" Battelle Labs, Columbus, Ohio 43201—(1983)—p.: (2 cover pages) PLNS (2-31).

Brakel, et al.—"Technical Feasibility and Energy Costs of Ultrafine Grinding of Coal"—1st Annual Pittsburgh Coal Conference Proceedings—Sep. 1984—U. of Pittsburgh—D.O.E. PETC pp. 726-734.

Meyers, et al.,—"The Gravimelt Process for Chemical Removal of Organic and Pyritic Sulfur from Coal'-'—AIChE Meeting-Symp. on Chem. Coal Cleaning—-Chicago, IL—USA—Nov., 1980.

Wheelock, T. D.—"Oxydesulfurization of Coal in Alkaline Solutions" Chem. Eng. Commun. Vol. 12, pp. 137-159 1981—AMES Laboratory, US DOE, Dept. of Chemical Engineering—Iowa State University AMES, Iowa 50011—pp. 137-159.

Kalvinsaks, et al—"Final Report: Coal Desulfurization by Low Temperature Chlorinolysis Phase III'-'—Pasadena, California-Mar. 1,1981 prepared for U.S.-D.O.E. via NASA by Jet Propulsion Laboratory California Institute of Technology—Cover Pg., Abstract, Introduction, Summary & Appendix G (Pages iii, 1,2-4, and 151-154 for Abstract through Appendix G Section, respectively).

Dryden, I.G.C.-"Action of Solvents on Coals at Lower Temperatures I-A Qualitative Survey of the Effects of Liquids Upon Bright Coals of Low Rank"—*Fuel*, XXX-2-pp. 39-44 (ALL) (1951).

Vasilakos, et al.—"Chemical Coal Beneficiation with Aqueous Hydrogen Peroxide/Sulfuric Acid Solutions'-'—Pres. Before the Div. of Petroleum Chemistry, Inc-.—AM. Chem. Society—Wash. D.C. Mtg.—Ang. 28th—Sep. 2, 1983-pp. 1239-1248.

Attar et al.—"Data on the Distribution of Organic Sulfur Functional Groups in Coals"—American Chemical Society, Division of Fuel Chemistry, Preprints: (24)(1):166-177 (1979) or in Advances in Chemistry pp. 239-256 (1981).

Attar, et al—"The Desulfurization of Organic Sulfur and the Transformations of Organic Sulfur Functional Groups in Coal Pyrolosis"—Chem. Eng. Commun. vol. 20—pp. 53-62 (1983).

Vecci, et al.—"Fuel & Ash Characterization and its Effect on the Design of Industrial Boilers"—presented to American Power Conference Apr. 24-26, 1978—B&W Paper #BR-1117 or PGTP 78-26.

Hippo et al.-"Coal Cleaning Employing Quaternary Salts"-Nov. 1985 issue of Mineral Matters vol. 7, No. 6-A Publ. of Southern Illinois University, Carbondale, Illinois.

*Primary Examiner*—Carl F. Dees

*Attorney, Agent, or Firm*—Vytas R. Matas; Robert J. Edwards

[57] ABSTRACT

Coal is immersed in an organic solvent for a sufficient time to induce swelling and natural fracture of the coal. The swelled coal is chemically leached to produce deep cleaned coal fines.

3 Claims, No Drawings

PROCESS FOR PRODUCING DEEP CLEANED COAL

BACKGROUND OF THE INVENTION

This invention relates to the production of deep cleaned coal by a physio-chemical cleaning and, more particularly, to a new and improved coal swelling technique to facilitate separation of inorganic impurities and sulfur compounds from coal.

There is a pressing need for an effective and economical method for cleaning coal which would encourage increased use of coal as an alternative utility energy source and meet air-quality standards without the use of flue gas desulfurization systems. Deep cleaned coal, containing less than 1% sulfur and 1% ash, not only can satisfy most current air-quality standards, but also is a potential alternative fuel in oil or gas-fired units. The low ash level, in particular, would also use of coal with minimal derating of equipment due to slagging, fouling, and erosion of heat transfer surfaces, thereby also improving the performance of coal combustion equipment.

Extensive research in deep coal cleaning is ongoing and uses either advanced physical or chemical cleaning approaches. Physical cleaning of coal employs mechanical grinding to liberate mineral impurities followed by selective separation to recover the cleaned product. Highly efficient comminution processes must be employed to obtain the extremely fine grinding needed for liberating mineral matter from the coal. In addition, high performance separation techniques are required for removing the fine ground mineral matter from the coal. The similarity of the surface and chemical characteristics of coal fines and mineral matter, especially pyrite, further complicates the separation, particularly as regards separation techniques that depend upon surface property differences for separation. Thus, the efficiency of physical cleaning depends on the degree of mineral liberation and the effectiveness of the selective separation technique. Usually, the more finely the coal is ground, the better the mineral liberation. Although ultrafine grinding (approximate maximum size of 10 microns) can help achieve maximum ash mineral liberation for most coals, it also can cause difficulties in downstream separation of coal fines without contamination by fine mineral particles and excessive Btu loss.

Existing advanced physical cleaning processes, with sophisticated separation techniques, such as selective oil agglomeration or selective flocculation procedures, can produce deep clean coal products containing less than 3% residual ash mineral content, but they all have to grind the coal down to the sub-micron particle size range before separation. The high energy consumption associated with ultrafine grinding, however, leads to an unacceptably high cost of production of the deep cleaned coal. It has been observed that the energy consumption for grinding coal to a size no greater than 10 microns is as high as 300 KWH/ton. Moreover, the inability of processes, such as selective oil agglomeration or selective flocculation procedures, to remove organic sulfur from coal limits the applicability of these advanced physical cleaning technologies to deep clean coal production.

Some chemical cleaning methods use chemical reagents to convert the solid mineral impurities into soluble or gaseous species which are then separated from the cleaned coal. Processing conditions which must be controlled include chemical concentration, temperature, pressure, and residence time. Difficulties in chemical cleaning of coal include maximizing the level of ash and sulfur reduction while minimizing volatile matter loss, undesirable side reactions, Btu loss, and operating costs.

While some existing advancing chemical cleaning processes can remove a high percentage of ash and a portion of organic sulfur, they also require intensive processing conditions. The TRW Gravimelt process, for example, can remove almost all the ash and up to 70% of the organic sulfur from coal with a molten caustic mixture of alkali metal hydroxide at 390° C. for 2 to 4 hours. These conditions, however, may cause volatile matter loss. The Ames Lab Wet Oxidation Process requires pressure and temperature which result in non-selective oxidation reactions, causing heat loss and low efficiency in coal sulfur removal. Also available chlorinolysis processes involve multiple steps, including a high temperature dechlorination procedure (up to 700° C.), which leaves a cleaned char product.

SUMMARY OF THE INVENTION

In in order to solve the problems faced by both physical and chemical cleaning processes, one aspect of this invention is to provide an innovative approach for producing deep cleaned coal at milder operating conditions and with lower energy consumption. The approach of this invention is to employ coal swelling technology to swell the coal, causing it to become more porous. This enhances the liberation of ash impurities and facilitates better mas transport of chemical reagents for reaction with unliberated ash impurities. The swelled porous coal also enhances evolution of the organic sulfur from the matrix during thermal hydrodesulfurization.

In accordance with the invention, air dried coal in medium ($\frac{1}{4}$ inch$\times$0 mesh) to fine (preferably above 28 mesh) particle size fractions, is subjected to coal swelling by soaking the coal in an organic solvent for the proper length of time to induce natural fracturing. Natural fracturing means that the fracturing is not caused by conventional mechanical force but by the solvent weakening the coal intermolecular cross-linkages and by the differences in the swellability of the various subcomponents such as macerals and mineral matter, causing uneven swelling within the coal. Such uneven swelling induces distortion and stresses and finally fractures the coal. The solvents are recovered for recycling by distillation at their boiling point or at lower temperatures under partial vacuum. The swelled coal can either be directly subjected to chemical leaching steps or subjected to a physical separation process before application of chemical leaching procedures.

Residual pyrite is removed by leaching the coal in an aqueous solution containing hydrogen peroxide and sulfuric acid, with continuous agitation at ambient temperature and pressure. The coal is then separated from the solution and the residual ash is removed by leaching the coal in an aqueous solution containing ammonium hydrogen fluoride, and hydrochloric acid at a temperature of 50° C. to 80° C. at ambient pressure. The coal is subsequently filtered and washed with water until the water shows a neutral pH. The coal is dried and prepared for organic sulfur removal. The dried coal is transferred to a reactor and subjected to a regulated flow rate of hydrogen at about 400° C. for a predetermined time. After this treatment, the coal is collected as a deep cleaned product.

DETAILED DESCRIPTION

Air-dried coal which is to be treated in accordance with the process is first subjected to swelling, by soaking the coal in an organic solvent at a 30 to 40 weight percent solids content for a time period sufficient to induce natural fracture. The time for swelling is approximately 6 to 8 hours, depending on the coal and its initial particle size.

The initial particle size of the coal should be ¼ inch×0 mesh and, more preferably, ¼×28 mesh. The solvent can be butylamine, propylamine or ethylene diamine. The solvents are recovered for recycling by distillation at their boiling point, or alternatively, by boiling at lower temperatures under partial vacuum.

The solvents swell the coal by weakening the intermolecular cross-linking and causing natural fracturing along surfaces between the organic matrix and impurities. The swelling causes the coal to become more friable towards grinding and enhances the liberation of ash impurities.

The swelled coal is subjected to grinding to a size range of minus 28 mesh or finer. At this stage, coal ash mineral impurities are partly liberated and partly still encased inside coal particles. A physical separation, such as float/sink or froth flotation, can be used to remove most of the liberated ash mineral impurities, leaving the residue mineral impurities to be removed chemically. In this way, the physical separation can help to reduce the chemical consumption in the chemical leaching steps. However, the swelled coal could also be subjected directly to chemical leaching without physical separation.

Thereafter, chemical leaching is used to remove residue impurity fines. The fine pyrite is removed by leaching with a 10 to 20%, preferably 20%, aqueous hydrogen peroxide solution containing 1 to 2% $H_2SO_4$ at ambient conditions. Other mineral matter, mostly aluminum silicate, is removed by leaching with an aqueous solution containing 3 to 6%, preferably 6%, of ammonium hydrogen fluoride and 2 to 3% of HNO3, at a moderate temperature (about 70° C.) and ambient pressure. The time needed for leaching is about one to two hours depending on the coal and its particle size.

Organic sulfur in coal has been shown to contain aliphatic and aromatic sulfides, disulfides, thios, and thiphenes. The thiosulfide and disulfide sulfur, which is about 30 to 50% of total organic sulfur, is removed easily by hydrodesulfurization for short periods, 10 to 20 minutes for minus 28 mesh size coal, at temperatures around 400° C., preferably not above 400° C., without losing significant volatile matter. The volatile matter release profile indicates a low rate of release for most coals at these temperatures.

The following examples and tables are illustrative and explanatory of the invention. All percentages are expressed as weight percentages unless otherwise indicated.

EXAMPLE I

Forty grams of ¼×10 mesh Kentucky No. 9 coal were air-dried and transferred into a 500 ml round bottom flask. Then, 120 ml of ethylene diamine was added to the coal and the mixture was allowed to sit for eight hours with occasional stirring. The solvent was then recovered by evaporation at a temperature of 78° C. under partial vacuum, using a nitrogen gas purge. The solvent was collected by condensation in a flask immersed in an ice bath. The solvent recovered was 95 percent by weight of the amount added and transparent in appearence. The swelled coal appeared dry and more friable as indicated by the ease with which it could be crushed with finger pressure. The swelled coal was then crushed to minus 100 mesh particle size and added to an 800 ml beaker containing 500 ml of heavy liquid medium, such as certigrav liquid, having a specific gravity of 1.6. The float portion (coal) at 1.6 specific gravity was collected and dried in air to prepare it for the chemical cleaning process. The dried coal was added to a 500 ml beaker containing 100 ml of 20% hydrogen peroxide and 1.5 ml of concentrate sulfuric acid and 98.5 ml of water. The mixture was stirred for about one hour at ambient temperature and pressure before filtration and water washing. The resulting coal was then added to a 500 ml beaker containing 15 grams of ammonium hydrogen fluoride, 40 ml of concentrated hydrochloric acid and 220 ml of water. The mixture was heated to 70° C. for an hour and was separated by filtration and water washed. This product was then dried in air and placed into a vertical reactor where it was purged with nitrogen. It was then heated to 390° C. under a nitrogen and hydrogen gas mixture (1 to 3 ratio at 250 ml/minute) for 20 minutes. The hydro-desulfurized coal was then cooled under nitrogen and finally collected for chemical analysis. The results are shown in Table 1.

TABLE I

| Kentucky No. 9 | Raw Coal | Swelled Coal 1.6 Float | Treated Coal |
|---|---|---|---|
| Weight, gm | 40 | 36.5 | 31.2 |
| Particle Size | ¼" × 10 mesh | −100 mesh | −100 mesh |
| Ash, % | 12.2 | 6.7 | 1.2 |
| Total Sulfur, % | 4.72 | — | 1.3 |
| Pyritic, % | 1.84 | — | 0.3 |
| Organic Sulfur, % | 2.72 | — | 1.0 |
| Volatile Matter, % | 39.8 | — | 35.5 |
| Nitrogen, % | 1.47 | — | 1.63 |

TABLE II

| Ohio No. 6 | Raw Coal | Treated Coal |
|---|---|---|
| Weight, gm | 40 | 36 |
| Particle Size | ¼" × 10 mesh | −100 mesh |
| Ash, % | 6.82 | 1.05 |
| Total Sulfur, % | 2.28 | 1.40 |
| Pyritic, % | 0.7 | 0.3 |
| Organic Sulfur, % | 1.42 | 1.0 |
| Volatile Matter, % | 41.7 | 40.5 |
| Nitrogen, % | 1.5 | 1.3 |

EXAMPLE II

Forty grams of prewashed Ohio No. 6, containing 6.8% by weight ash, was treated exactly as in Example I, except that the float/sink separation step was omitted because of the low initial ash content in the raw coal. The results are shown in Table 2.

The results of the tests in the two examples indicate that the process of the invention achieved removal of up to 91% ash, 72% total sulfur and 46% organic sulfur from the raw coal, in Example I, without large losses in volatile matter content. A similar result is demonstrated by the results of Example II.

Use of the process of the invention for coal beneficiation provides several advantages over the existing advanced physical and advanced chemical cleaning processes. Application of swell technology to induce a natural fracturing in the coal, makes it more friable and promotes the efficient libration of mineral matter in its inherent particle size. This helps to minimize the production of mineral fines, which accompanies ultrafine grinding normally required to maximize mineral liberation. Minerals are removed after swelling by relatively mild crushing. Since the swelled coal is more porous, mass transport of the chemical reagents is enhanced in downstream chemical treatment for removing residual mineral impurities and organic sulfur by hydrosulfurization. This allows milder treatment conditions as regards temperature, pressure, residence time, and reagent concentration for removal of finely disseminated mineral impurities. The evidence of the swelled coal facilitating better mass transport was observed by comparing the swell rate of a raw coal to that of swelled coal in the same solvent under the same conditions. In a test of Ohio Sunnyhill seam coal ($\frac{1}{4}\times 10$ mesh) with n-butylamine, it took 6 hours for the raw coal to attain the maximum swell, but it took less than one hour for a dried swelled coal to be swelled again to attain the same maximum volume. This means that it is much easier for the solvent to penetrate into a swelled coal than into the raw coal.

The physiochemical process of this invention, moreover, takes advantage of both physical and chemical cleaning processes. More coarse mineral particles are removed during physical separation and finely disseminated mineral particles are dissolved by milder chemical leaching. Thus, the process avoids energy intensive ultrafine grinding and difficult separation of mineral fines typical of most advanced physical cleaning processes. The process also avoids the vigorous operating conditions which are often cited as major obstacles for application of chemical treatment for coal cleaning. Furthermore, the hydrogen-desulfurization of swelled coal under relatively mild conditions achieves favorable organic sulfur reductions compared with other existing chemical processes, without loss of significant volatile matter. Finally, the process of this invention is flexible. It allows the processing of a variety of coals with different physical and chemical characteristics For example, for low pyrite content coal, hydrogen peroxide leaching can be omitted. For low organic sulfur content coal, hydrodesulfurization would be unnecessary. Other advantages will be apparent to those who are skilled in the art.

The invention claimed is:

1. A physio-chemical process for producing deep cleaned coal, comprising the steps of:

providing a supply of air-dried coal of particle size fractions of no greater than $\frac{1}{4}$ inch$\times$0 mesh;

immersing the coal in an organic solvent selected from the group consisting of butylamine, propylamine, and ethylene diamine, to form a mixture, having coal in an amount to provide no greater than 40 weight percent solids content, for a time period sufficient to swell the coal and to induce natural fracturing of the coal;

processing the mixture to recover the organic solvent;

subjecting the swelled coal to grinding to a particle size range of minus 28 mesh or finer;

subjecting the swelled coal to leaching with a 10 to 20% aqueous hydrogen peroxide solution containing 1 to 2% sulfuric acid at ambient conditions to remove residual pyrite from the coal; and subjecting the swelled coal to leaching with an aqueous solution containing 3 to 6% ammonium hydrogen fluoride and 2 to 3% of nitric acid or hydrochloric acid to remove residual ash from the coal.

2. The physio-chemical process for producing deep cleaned coal as set forth in claim 1, further comprising the step of heating the swelled and leached coal to a temperature of about 390° C. under a nitrogen and hydrogen gas mixture for a time sufficient to form hydrodesulfurized coal.

3. The physio-chemical process for producing deep cleaned coal as set forth in claim 1, further comprising the step of subjecting the ground and swelled coal to a physical separation process, prior to the leaching steps, to remove most of the liberated ash mineral impurities and reduce the chemical consumption in the subsequent leaching steps.

* * * * *